US006193416B1

(12) United States Patent
Kawamata et al.

(10) Patent No.: US 6,193,416 B1
(45) Date of Patent: Feb. 27, 2001

(54) GUSSETED BAG

(75) Inventors: Shigeyuki Kawamata; Michiaki Fujita, both of Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/269,187

(22) PCT Filed: Sep. 22, 1997

(86) PCT No.: PCT/JP97/03362

§ 371 Date: Mar. 29, 1999

§ 102(e) Date: Mar. 29, 1999

(87) PCT Pub. No.: WO98/13272

PCT Pub. Date: Apr. 2, 1998

(30) Foreign Application Priority Data

Sep. 27, 1996 (JP) ..... 8-277343

(51) Int. Cl.[7] ..... B65D 30/16
(52) U.S. Cl. ..... 383/104; 383/120; 383/906
(58) Field of Search ..... 383/35, 104, 120, 383/121, 207, 209, 906

(56) References Cited

U.S. PATENT DOCUMENTS 186,009 * 1/1877 Jordan et al. ..... 383/35
3,051,368 * 8/1962 Schneider et al. ..... 383/906 X
3,119,548 * 1/1964 Cook et al. ..... 383/121
3,663,239 * 5/1972 Rowe et al. ..... 383/906 X
4,454,979 * 6/1984 Ikeda et al. ..... 383/906 X
5,059,035 * 10/1991 Kristensen ..... 383/906 X
5,433,526 * 7/1995 Wild ..... 383/104 X
5,547,284 * 8/1996 Imer ..... 383/906 X
5,882,117 * 3/1999 Laffon ..... 383/906 X
5,941,643 * 8/1999 Linkiewicz ..... 383/906 X

FOREIGN PATENT DOCUMENTS

WO 97/35783 10/1997 (EP) .

* cited by examiner

*Primary Examiner*—Jes F. Pascua
(74) *Attorney, Agent, or Firm*—Oblon, Spivak, McClelland, Maier & Neustadt, P.C.

(57) ABSTRACT

A gusseted bag has inwardly-folded V-shaped folds at left and right opposing sidewalls of the bag and has sealed portions at vertical edges of the upper part of the bag. At this upper part of the bag, the distance between inside contours of the sealed portions set opposite one another in the horizontal direction is narrowed with respect to the body of the bag to form a non-sealed portion serving as a pour spout, and outside contours of the sealed portions forming the pour spout form an outer shape narrowed with respect to the body of the bag. The pour spout may be positioned eccentrically toward one side of the sidewalls. Thus, it may become possible to re-bottle the contents with ease and for sure even into narrow-necked bottle containers.

18 Claims, 16 Drawing Sheets

1 F

1 B

1 B

1C

1 I

1 I

1y

GUSSETED BAG

TECHNICAL FIELD

This invention relates to a gusseted bag useful as a rebottling container.

BACKGROUND ART

In recent years, to cope with problems of trash which are caused by disposal of plastic bottles, it has become popular to take the form of distribution that contents are sold by putting them into rebottling containers such as standing pouches or gusseted bags and consumers rebottle the contents into bottle containers to put them into use.

FIG. 20 is a front view of a gusseted bag 1*x* commonly used as a rebottling container, which is not filled with a content and stands folded flat with its top opening 2*x* sealed. FIG. 21 is a perspective view of this gusseted bag 1*x*, which stands sealed at its opening 2*x* after the gusseted bag 1*x* has been filled with contents from its top opening 2*x*.

FIG. 22 is a front view of a gusseted bag 1*y* also known as a rebottling container, which is not filled with contents and stands folded flat with its pour spout 2 unsealed. FIG. 23 is a perspective view of this gusseted bag 1*y*, which stands sealed at its pour spout 2 after the gusseted bag 1*x* has been filled with contents. FIG. 24 is a perspective view of the vicinity of the pour spout 2 in an instance where the gusseted bag 1*y* is opened by cutting off its upper part along a broken line L.

As shown in these drawings, the gusseted bags 1*x* and 1*y* are bag-like containers having inward-folded V-shaped folds at their opposing both sidewalls 3, and these V-shaped folds at the both sidewalls are greatly characteristic of the gusseted bags in contrast with the standing pouches.

When a consumer makes use of the contents with which the FIG. 21 gusseted bag 1*x* is filled, the consumer cuts off a sealed portion 4 at the top of the bag at any desired position, using scissors or the like, and rebottles the container into a certain bottle container.

In the case of the gusseted bag 1*y* shown in FIGS. 22 to 24, it has the sealed portion 4 also at the vertical edges of the bag, and the distance between inside contours 4*a* of sealed portions 4 set opposite one another in the horizontal direction is narrowed toward the upper part with respect to the body of the bag, thus the unsealed portion positioned between these opposing inside contours 4*a* serves as the pour spout 2. Accordingly, when a consumer makes use of the contents with which the gusseted bag 1*y* is filled, the consumer cuts off the upper part of the gusseted bag 1*y* filled with the contents, along a broken line L using scissors or the like to open the pour spout 2 as shown in FIG. 24, and rebottles the container into a certain bottle container.

However, no pour spout is formed in the conventional gusseted bag 1*x* shown in FIG. 21, and hence it is difficult for the consumer to rebottle the contents into a bottle container, where problems have occurred such that the contents spill or are scattered around.

In the gusseted bag 1*y* shown in FIG. 23, the pour spout 2 is formed, but the sealed portions 4 around the pour spout 2 still remain as extensions of the sealed portions at the vertical edges of the body of the bag. Hence, when the contents are rebottled into a narrow-necked bottle container, the pour spout 2 of the gusseted bag 1*y* can not be inserted into the mouth of such a bottle container to cause the problems that the contents spill or are scattered around.

The present invention aims at solving the problems in the prior art as stated above. Accordingly, an object of the present invention is to provide a gusseted bag from which the contents can be rebottled with ease and for sure even into narrow-necked bottle containers.

DISCLOSURE OF THE INVENTION

To achieve the above object, the present inventors provide a gusseted bag comprising a bag having i) inward-folded V-shaped folds at its opposing both sidewalls and ii) sealed portions at vertical edges of the upper part of the bag; wherein, at the upper part of the bag, the distance between inside contours of the sealed portions set opposite one another in the horizontal direction is narrowed with respect to the body of the bag to form a non-sealed portion serving as a pour spout, and outside contours of the sealed portions forming the pour spout form an outer shape narrowed with respect to the body of the bag.

In particular, in this gusseted bag, an embodiment is provided in which the pour spout is positioned eccentrically toward one side of the sidewalls, and an embodiment in which the bag has, at a wall surface portion forming the pour spout, a ruled line so formed that the wall surface portion is foldable outward.

According to the gusseted bag of the present invention, the outside contours of the sealed portions forming the pour spout form an outer shape narrowed with respect to the body of the bag. Hence, when the contents of the gusseted bag are rebottled into a certain container, the contents can be rebottled by inserting the pour spout of the gusseted bag into the mouth of the container even if the container is a narrow-necked bottle container. Accordingly, the contents can be prevented from splitting or being scattered around, and the rebottling can be operated with ease.

In particular, in the gusseted bag of the present invention, according to the embodiment in which the pour spout is positioned eccentrically toward one side of the sidewalls and the embodiment in which the bag has, at a wall surface portion forming the pour spout, a ruled line so formed that the wall surface portion is foldable outward, the pour spout can be readily opened even if it has a narrow neck, and hence the contents can be more easily rebottled from the gusseted bag to the bottle container.

BRIEF DESCRIPTION OF THE DRAWINGS

FIG. 8A is a plan view of the gusseted bag standing folded flat, and FIGS. 8B to 8D are top views of the pour spout.

FIG. 10A is a plan view of the gusseted bag standing folded flat, and FIGS. 10B and 10C are top views of the pour spout.

FIG. 11A is a plan view of the gusseted bag standing folded flat, and FIGS. 11B and 11C are top views of the pour spout.

FIG. 12A is a plan view of the gusseted bag standing folded flat, and FIGS. 12B and 12C are top views of the pour spout.

FIG. 13A is a plan view of the gusseted bag standing folded flat, and FIGS. 13B and 13C are top views of the pour spout.

FIG. 18A is a perspective view of the vicinity of the pour spout, and FIG. 18B is a top view of the pour spout.

BEST MODE FOR CARRYING OUT THE INVENTION

Figure 1:
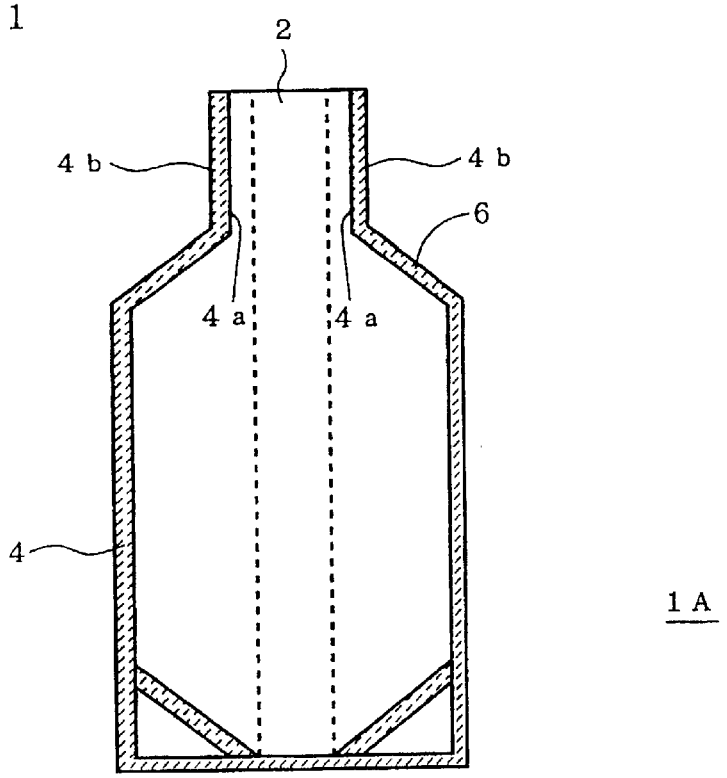
FIG. 1 is a front view of the gusseted bag of the present invention, which stands folded flat.

The present invention will be described below in detail with reference to the drawings. In the drawings, like reference numerals denote like or equivalent constituents.

Figure 2:
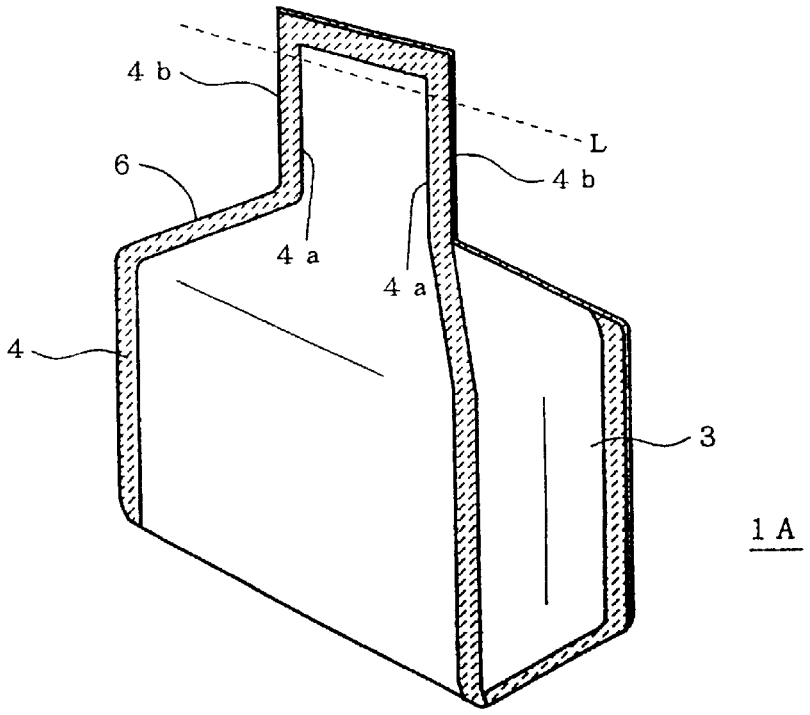
FIG. 2 is a perspective view of the gusseted bag of the present invention, which stands sealed at its pour spout after it has been filled with contents.
Figure 3:
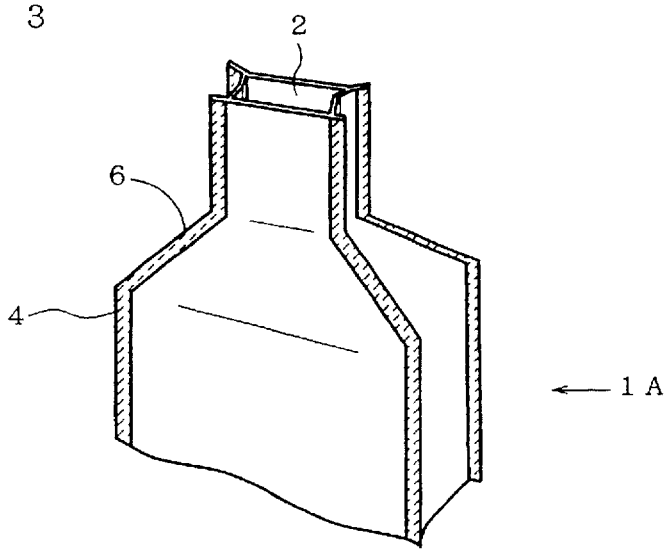
FIG. 3 is a perspective view of the vicinity of the pour spout in the gusseted bag of the present invention.

FIG. 1 is a front view of a gusseted bag 1A of the present invention, which is not filled with contents and stands folded flat with its pour spout 2 unsealed. FIG. 2 is a perspective view of this gusseted bag 1A, which stands sealed at its pour spout 2 after it has been filled with contents. FIG. 3 is a perspective view of the vicinity of the pour spout 2 in an instance where the upper part of the gusseted bag 1A shown in FIG. 2 is cut off along a broken line L to open the bag.

Figure 22:
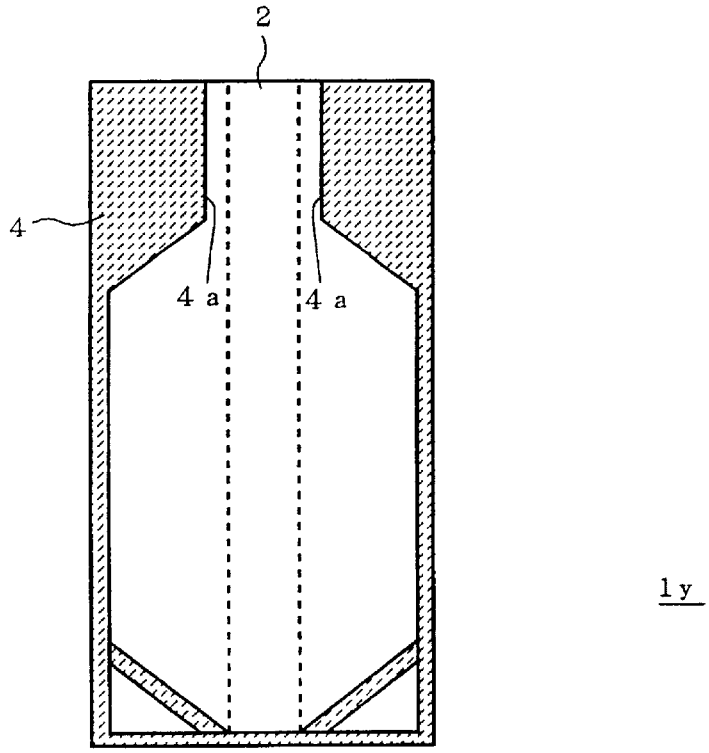
FIG. 22 is a front view of a conventional gusseted bag, which stands folded flat.
Figure 23:
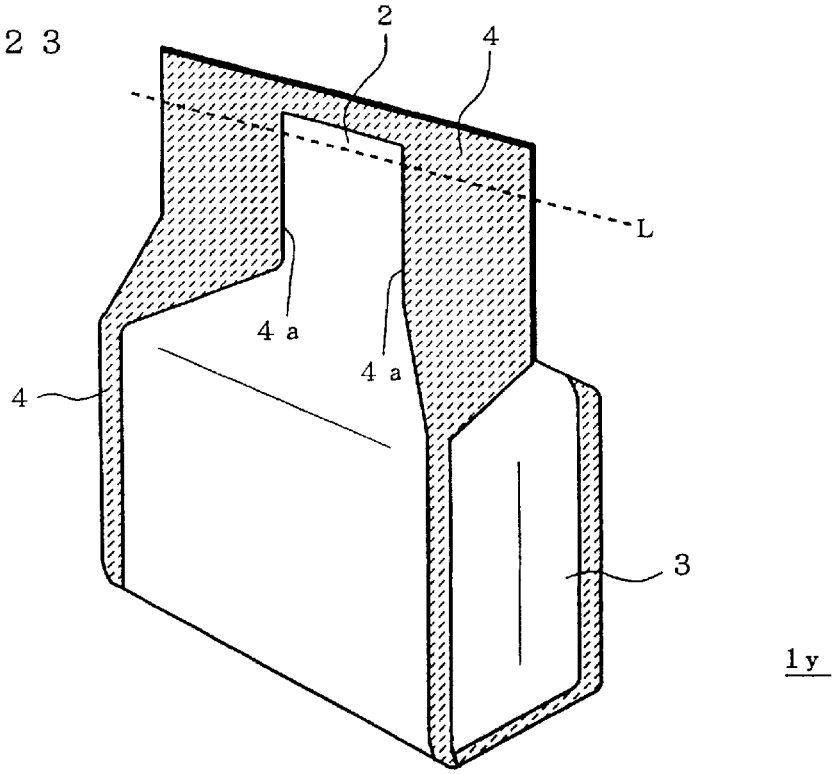
FIG. 23 is a perspective view of a conventional gusseted bag, which stands sealed at its pour spout after it has been filled with contents.
Figure 24:
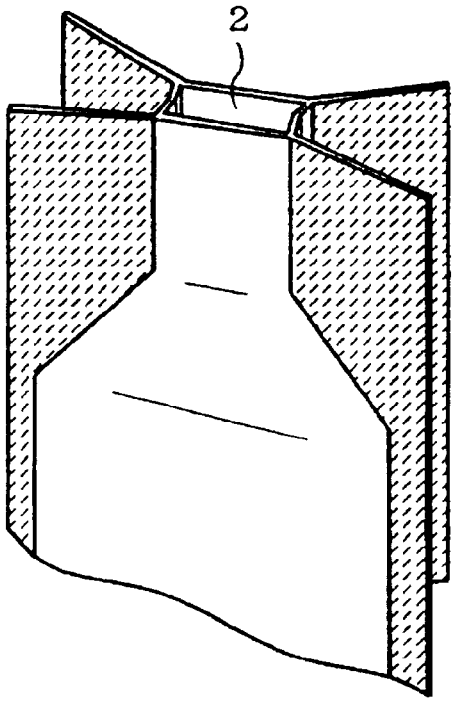
FIG. 24 is a perspective view of the vicinity of the pour spout in the conventional gusseted bag.

As shown in these drawings, the gusseted bag 1A is, like the conventional gusseted bag 1*y* shown in FIGS. 22 to 24, a bag-like container having the inward-folded V-shaped folds at their opposing both sidewalls 3, and sealed portions 4 formed at vertical edges of the bag. In FIG. 1, broken lines show innermost ends of the V-shaped folds. At the upper part of the gusseted bag 1A, the distance between inside contours 4*a* of the sealed portions 4 set opposite one another is narrowed with respect to the body of the bag, and a non-sealed portion formed between them serves as the pour spout 2. However, in the gusseted bag 1A shown in FIGS. 1 to 3, outside contours 4*b* of the sealed portions 4 forming the pour spout 2 are cut out along the inside contours 4*a* so that the sealed portions has an outer shape narrowed with respect to the body of the bag.

Figure 4:
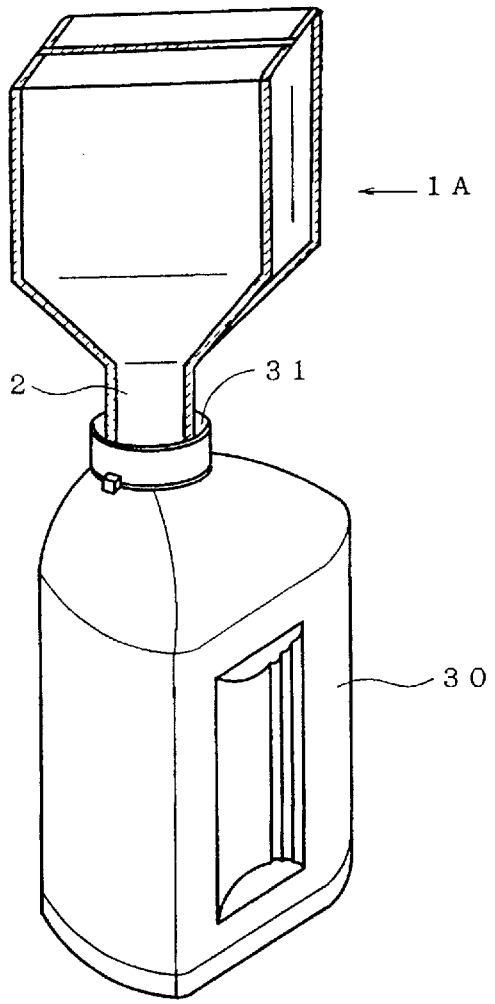
FIG. 4 illustrates how the contents are rebottled from the gusseted bag of the present invention into a bottle container.

Thus, as shown in FIG. 4, when the contents with which the gusseted bag 1A is filled are rebottled into a narrow-necked bottle container 30, it becomes possible to insert the pour spout 2 of the gusseted bag 1A into the mouth 31 of the bottle container 30. Accordingly, it becomes possible to rebottle the contents with ease and for sure without causing split or scatter of contents.

Figure 5A:
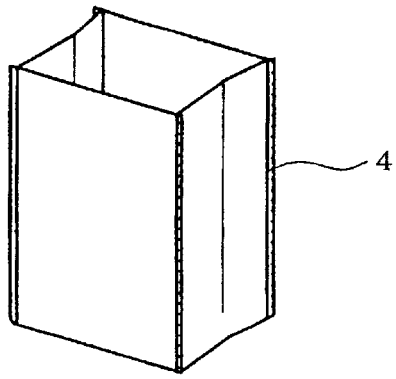
FIGS. 5A to 5D illustrate how to form the sealed portions around the pour spout in the gusseted bag of the present invention.
Figure 5B:
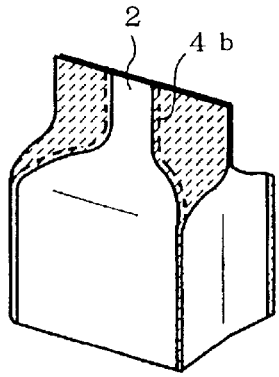

As methods for forming the sealed portions 4 at the pour spout 2 of this gusseted bag 1A, they may be formed by cutting out the outside contours 4*b* of the sealed portions 4 so as to form the outer shape as shown in FIG. 1, before the bag is filled with contents. Alternatively, as shown in FIGS. 5A to 5D, the outside contours 4*b* of the sealed portions 4 may be cut out after the bag has been filled with contents. More specifically, as shown in FIG. 5A, first the bottom and sidewall vertical edges of a sheet material used to form the bag are bonded by heat fusion or with an adhesive to form the sealed portions 4, thus a bag member having a widely open top is formed. Next, after the bag member is filled with contents, the surrounding of the pour spout 2 may be sealed and also the outside contours 4*b* may be cut out at the sealed portions (FIG. 5B).

Figure 5C:
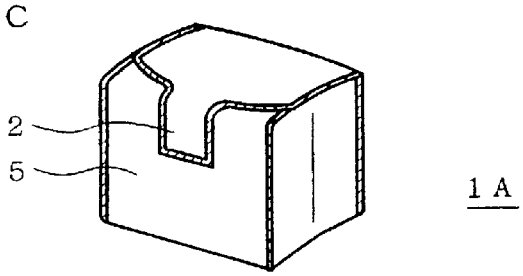

After the narrowed outer shape of the sealed portions 4 around the pour spout 2 is formed by cutting out the outside contours 4*b*, the top edge of the pour spout 2 is further bent as shown in FIG. 5C to provisionally fix the vicinity of the pour spout 2 to the wall surface 5 of the body of the bag by the use of a hot melt or a tack seal so that the bag can have a form suited for its distribution.

Figure 5D:
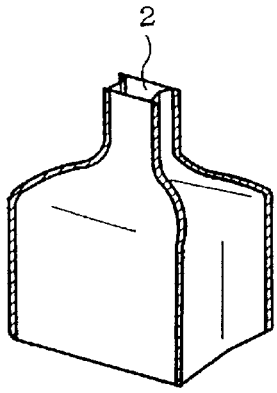

When a consumer makes use of the contents with which the gusseted bag 1A is filled, the consumer unfastens the provisional fixture and cuts off with scissors or the like the top edge of the pour spout 2 having been sealed, to open the pour spout 2 as shown in FIG. 5D.

In addition to the foregoing gusseted bag 1A shown in FIGS. 1 to 4, the present invention can have various embodiments so long as the outside contours at the sealed portions forming the pour spout 2 form the outer shape narrowed with respect to the body of the bag.

Figure 6:
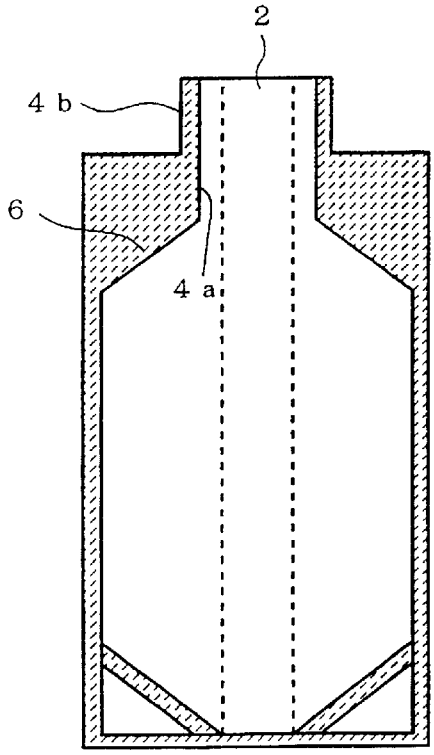
FIG. 6 is a front view of the gusseted bag of the present invention, which stands folded flat.
Figure 7:
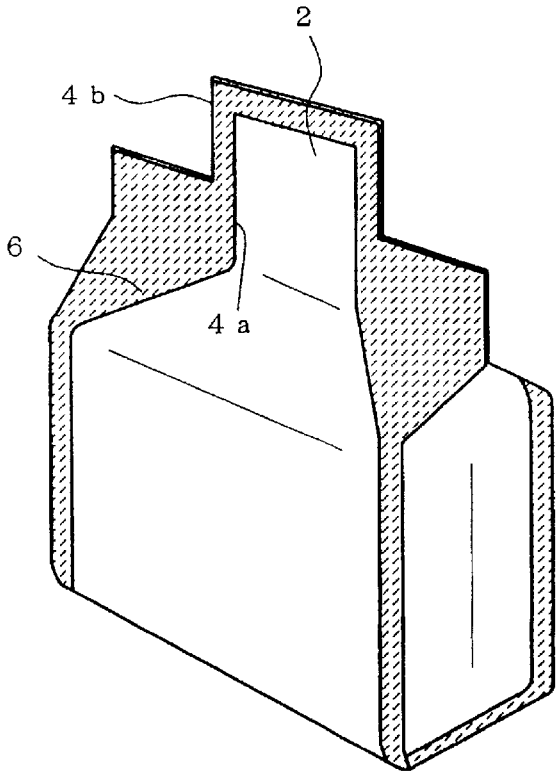
FIG. 7 is a perspective view of the gusseted bag of the present invention, which stands sealed at its pour spout after it has been filled with contents.

For example, in the gusseted bag 1A shown in FIGS. 1 to 4, the outside contours 4*b* extend along the inside contours 4*a* not only at the sealed portions 4 forming the pour spout 2 but also at the sealed portions 4 forming shoulders 6 of the bag. However, in the present invention, the outside contours 4*b* of the sealed portions 4 need not necessarily be made to extend along the inside contours 4*a* from the shoulders 6 of the bag to the pour spout 2. For example, as in the case of a gusseted bag 1B shown in FIG. 6 and as shown in FIG. 7 illustrating the gusseted bag 1B, which stands sealed at its pour spout 2 after it has been filled with contents, the outside contours 4*b* need not extend along the inside contours 4*a* at the shoulders 6 and may form wide sealed portions, so long as the outside contours 4*b* at the sealed portions 4 forming the pour spout 2 of the gusseted bag 1B are formed so as to be narrowed along the inside contours 4*a*.

Figure 8A:
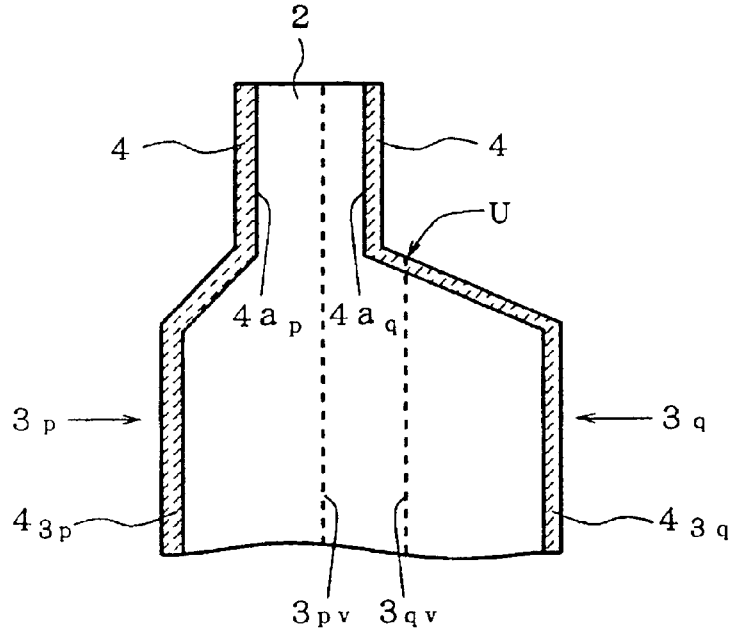
FIGS. 8A to 8D illustrate the gusseted bag of the present invention, having a pour spout eccentrically positioned.
Figure 8B:
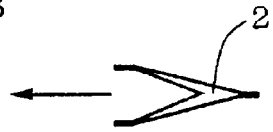
Figure 8C:
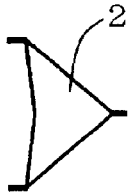
Figure 8D:
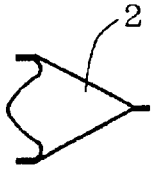

FIGS. 8A to 8D are views of a gusseted bag 1C of the present invention according to still another embodiment, i.e., a plan view of the gusseted bag standing folded flat (FIG. 8A) and top views of the pour spout 2 (FIGS. 8B to 8D).

In this gusseted bag 1C, an inside contour $\mathbf{4}a_p$ on the side of a sidewall $\mathbf{3}_p$ of the sealed portions 4 forming the pour spout 2 is formed between an innermost end $\mathbf{3}_{pv}$ of the V-shaped fold in the sidewall $\mathbf{3}_p$ and a sealed portion $\mathbf{4}_{3p}$ of the vertical edge on the sidewall $\mathbf{3}_p$, and an inside contour $\mathbf{4}a_q$ on the other side of the sealed portions 4 forming the pour spout 2 is formed between innermost ends $\mathbf{3}_{pv}$ and $\mathbf{3}_{qv}$ of the V-shaped folds in the both sidewalls $\mathbf{3}_p$ and $\mathbf{3}_q$, respectively, thus the pour spout 2 is positioned eccentrically toward the one side, sidewall $\mathbf{3}_p$ side.

Figure 9:
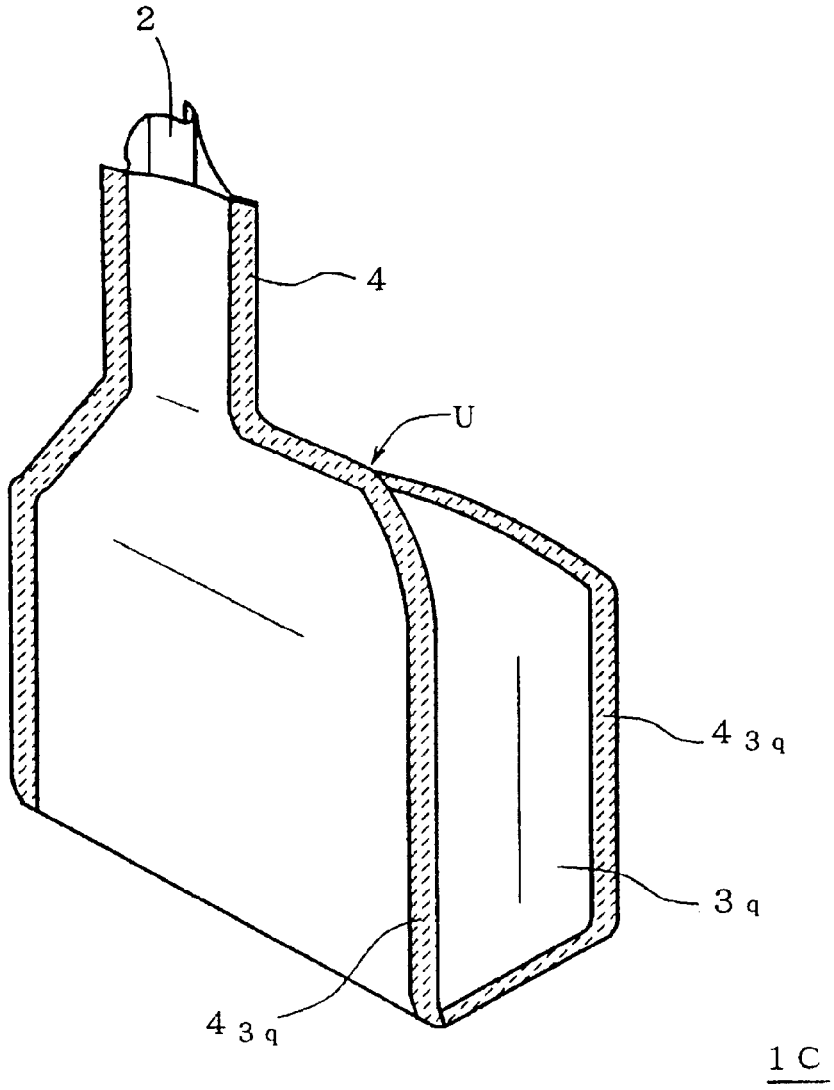
FIG. 9 is a perspective view of the gusseted bag of the present invention, having the pour spout eccentrically positioned.

Hence, when the pour spout 2 is pulled out toward the one side in the direction of an arrow, sidewall $\mathbf{3}_p$ side as shown in FIG. 8B, a large opening can be formed as shown in FIG. 8C. Also, when as shown in FIGS. 8D and 9 the wall surface of the pour spout 2 is bent in the direction opposite to the initial fold direction, this pour spout 2 can be kept open stably and widely. Accordingly, it becomes possible to more easily rebottle the contents. For further details, two sealed portions $\mathbf{4}_{3q}$ of the vertical edge on the sidewall $\mathbf{3}_q$ unify at the point U between the sealed portion 4 forming the pour spout 2 and the sealed portions $\mathbf{4}_{3q}$ of the body of the bag as shown in FIGS. 8A and 9.

In the gusseted bag of the present invention, it can have still other various embodiments as embodiments in which the pour spout 2 is formed at an eccentric position.

Figure 10A:
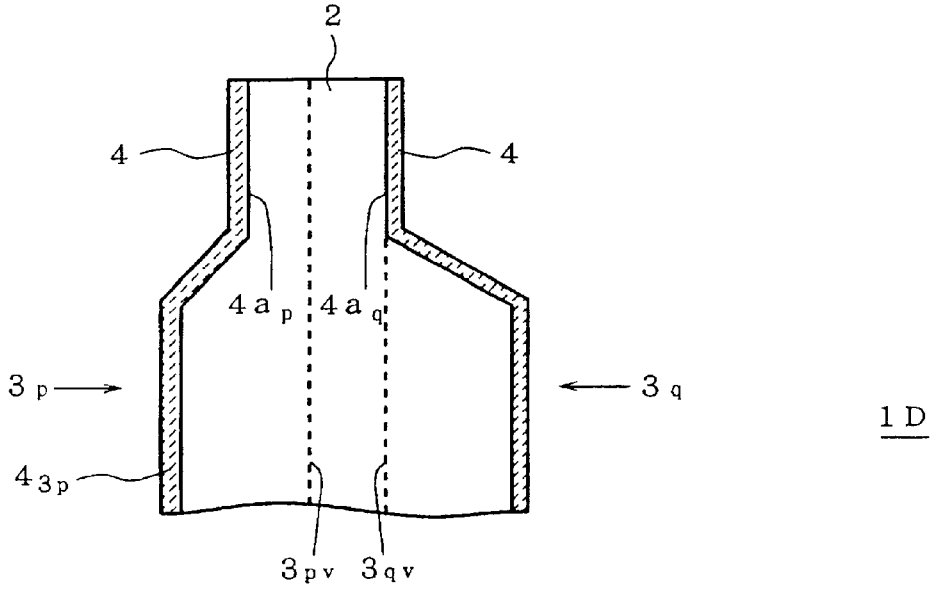
FIGS. 10A to 10C illustrate the gusseted bag of the present invention, having a pour spout eccentrically positioned.
Figure 10B:
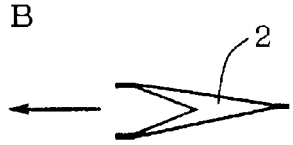
Figure 10C:
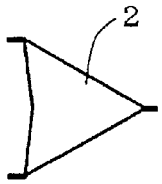

For example, in a gusseted bag 1D shown in FIG. 10A, the inside contour $\mathbf{4}a_p$ on the side of the sidewall $\mathbf{3}_p$ of the sealed portions 4 forming the pour spout 2 is formed between the innermost end $\mathbf{3}_{pv}$ of the V-shaped fold in the one side sidewall $\mathbf{3}_p$ and the sealed portion $\mathbf{4}_{3p}$ of the vertical edge on the sidewall $\mathbf{3}_p$, and the inside contour $\mathbf{4}a_q$ on the other side of the sealed portions 4 forming the pour spout 2 is formed in agreement with the innermost end $\mathbf{3}_{qv}$ of the V-shaped fold in the sidewall $\mathbf{3}_q$ located on the other side. Hence, when the pour spout 2 is pulled out in the direction of an arrow as shown in FIG. 10B, a larger opening than that of the gusseted bag 1C shown in FIG. 9 can be formed (FIG. 10C).

Figure 11A:
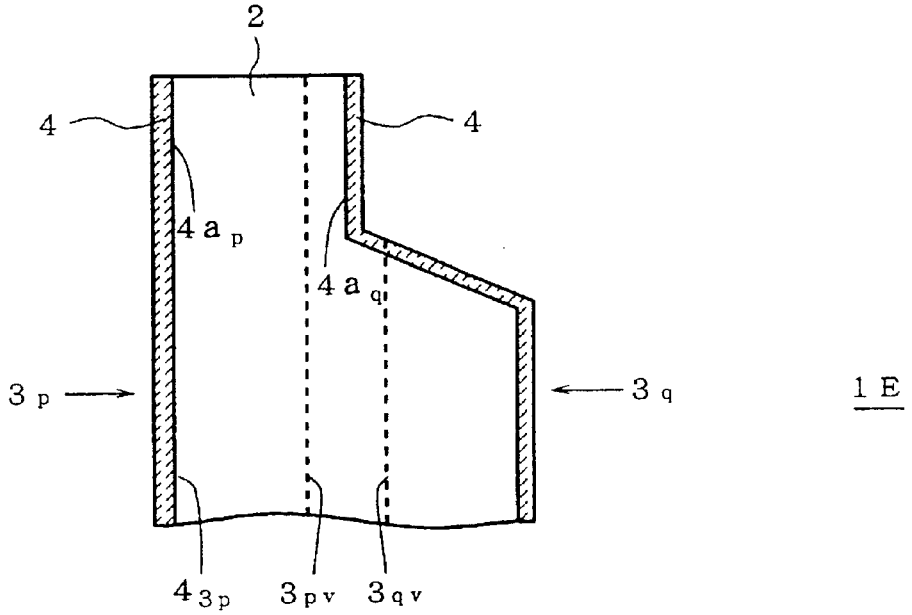
FIGS. 11A to 11C illustrate the gusseted bag of the present invention, having a pour spout eccentrically positioned.
Figure 11B:
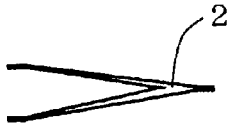
Figure 11C:
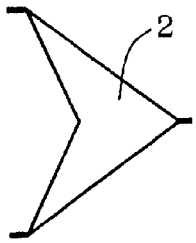

As in the case of a gusseted bag 1E shown in FIG. 11A, the inside contour $\mathbf{4}a_p$ on the side of the sidewall $\mathbf{3}_p$ on one side of the sealed portions 4 forming the pour spout 2 is formed so as to be in agreement with the inside contour of the sealed portion $\mathbf{4}_{3p}$ of the vertical edge on the sidewall $\mathbf{3}_p$, and the inside contour $\mathbf{4}a_q$ on the other side of the sealed portions 4 forming the pour spout 2 is formed between innermost ends $\mathbf{3}_{pv}$ and $\mathbf{3}_{qv}$ of the V-shaped folds in the both sidewalls $\mathbf{3}_p$ and $\mathbf{3}_q$, respectively, thus the pour spout 2 can be more largely opened as shown in FIGS. 11B and 11C.

Figure 12A:
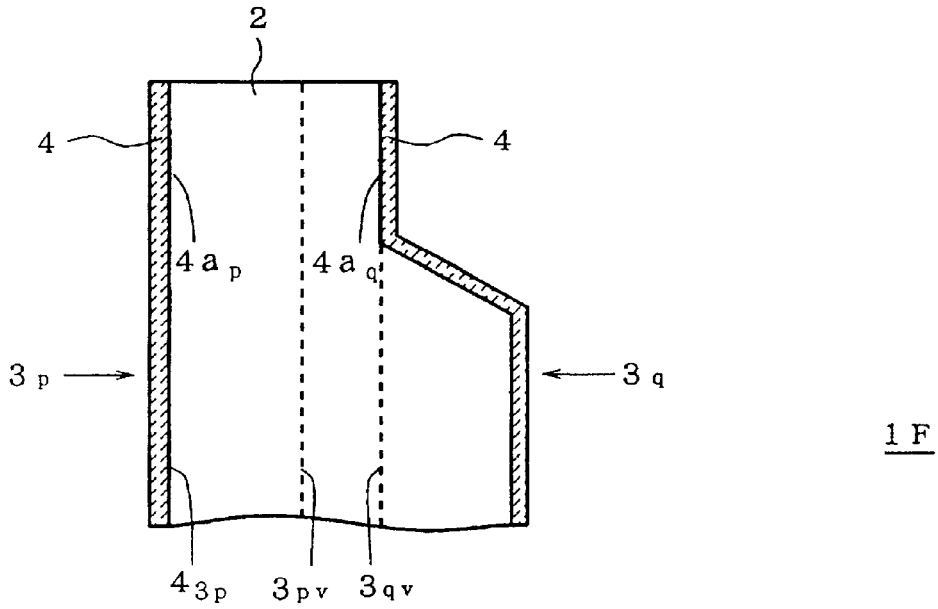
FIGS. 12A to 12C illustrate the gusseted bag of the present invention, having a pour spout eccentrically positioned.
Figure 12B:
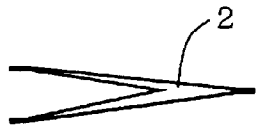
Figure 12C:
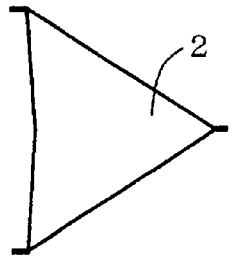
Figure 13A:
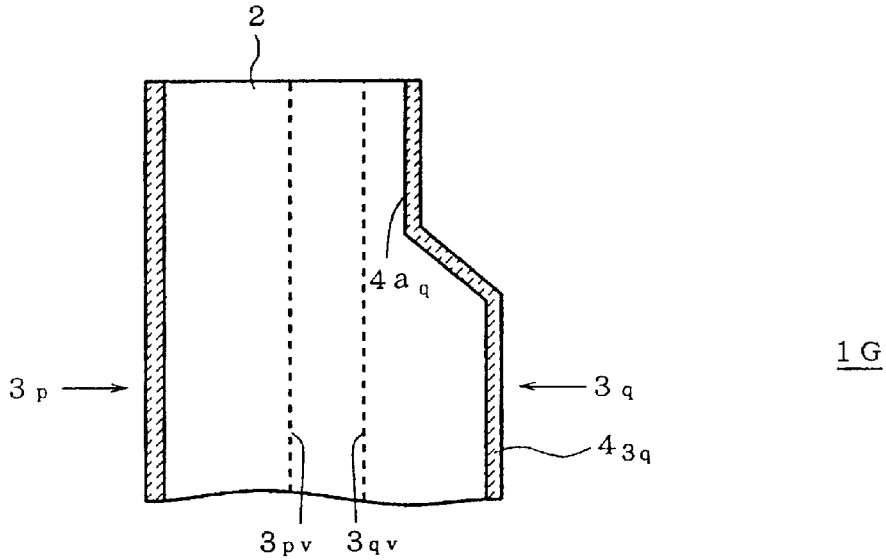
FIGS. 13A to 13C illustrate the gusseted bag of the present invention, having a pour spout eccentrically positioned.
Figure 13B:
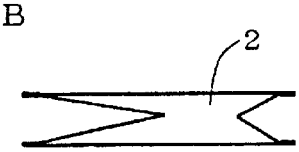
Figure 13C:
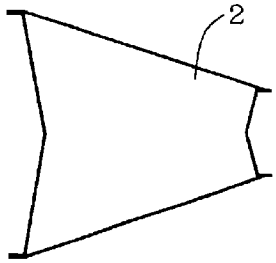

In an embodiment in which, like the gusseted bag 1E shown in FIG. 11A, the inside contour $\mathbf{4}a_p$ on the side of the sidewall $\mathbf{3}_p$ of the sealed portions 4 forming the pour spout 2 is formed so as to be in agreement with the inside contour of the sealed portion $\mathbf{4}_{3p}$ of the vertical edge on the sidewall $\mathbf{3}_p$, the inside contour $\mathbf{4}a_q$ on the other side of the sealed portions forming the pour spout 2 may be formed in agreement with the innermost end $\mathbf{3}_{qv}$ of the V-shaped folds in the sidewall $\mathbf{3}_q$ located on the other side as in the case of a gusseted bag 1F shown in FIG. 12A. Thus, the pour spout 2 can be still more largely opened as shown in FIGS. 12B and 12C. Also, as in the case of a gusseted bag 1G shown in FIG. 13A, the inside contour $\mathbf{4}a_q$ on the side of the sidewall $\mathbf{3}_q$ of the sealed portions forming the pour spout 2 may be formed between the innermost end $\mathbf{3}_{qv}$ of the V-shaped folds in the sidewall $\mathbf{3}_q$ and the sealed portion $\mathbf{4}_{3q}$ of the vertical edge on the sidewall $\mathbf{3}_q$. Thus, the pour spout 2 can be still more largely opened as shown in FIGS. 13B and 13C.

Eccentrically positioning the pour spout 2 in this way makes it possible to greatly change the size of the opening of the pour spout 2. How far the pour spout 2 is eccentrically positioned may be determined according to the type of contents, the shape of the bottle container to which the contents are rebottled, the materials for the gusseted bag, and so forth.

Figure 14:
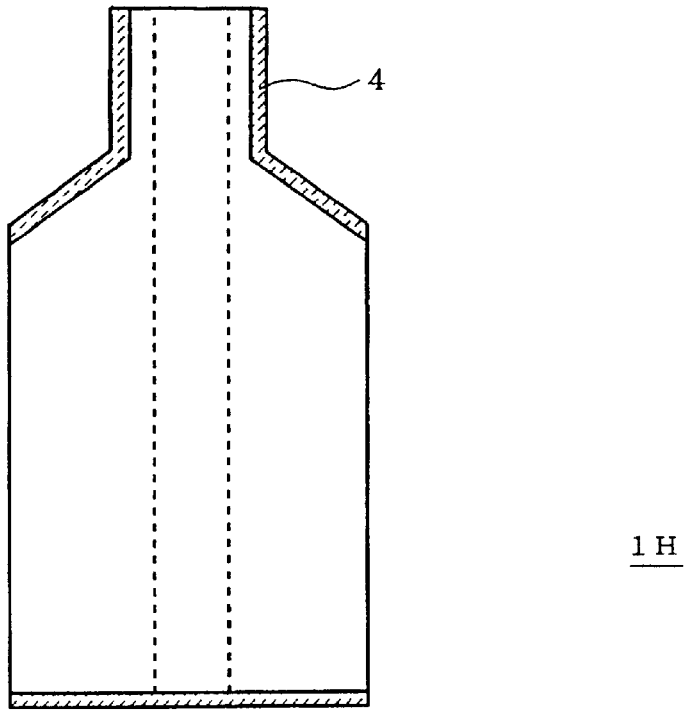
FIG. 14 is a plan view of the gusseted bag of the present invention, having no sealed portions at the vertical edges of the body of the bag, which stands folded flat.
Figure 15:
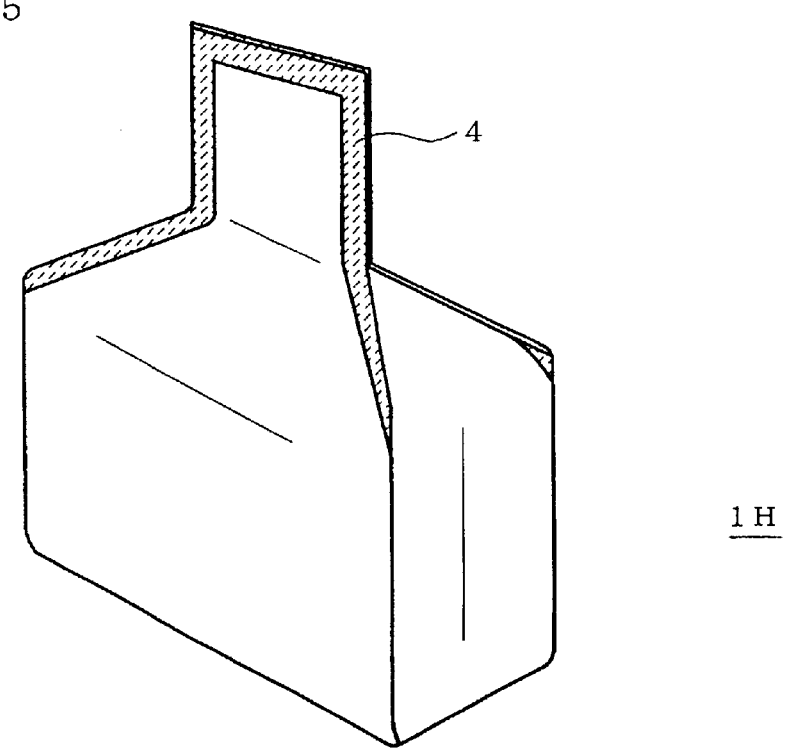
FIG. 15 is a perspective view of the gusseted bag of the present invention, having no sealed portions at the vertical edges of the body of the bag, which stands sealed at its pour spout after it has been filled with contents.
Figure 16:
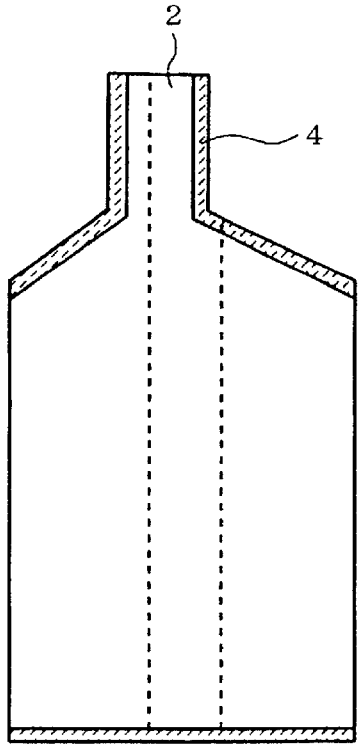
FIG. 16 is a plan view of the gusseted bag of the present invention, having no sealed portions at the vertical edges of the body of the bag and having a pour spout eccentrically positioned, which stands folded flat.
Figure 17:
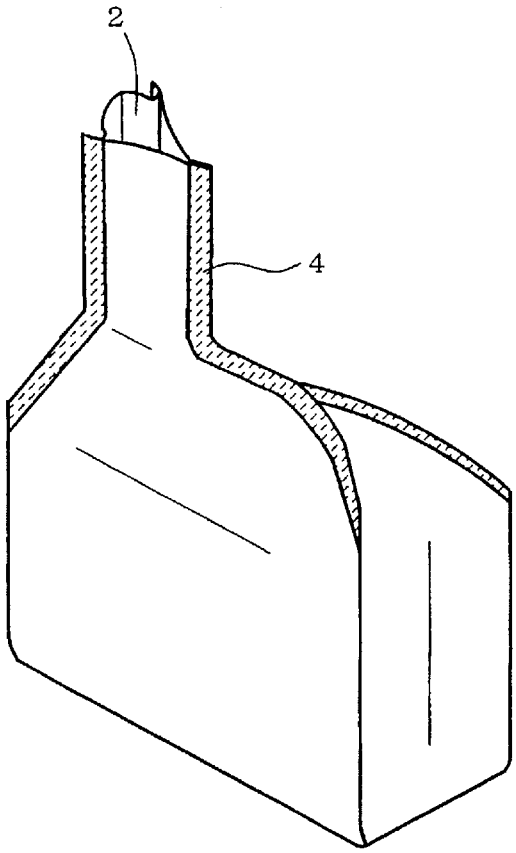
FIG. 17 is a perspective view of the gusseted bag of the present invention, having no sealed portions at the vertical edges of the body of the bag and having a pour spout eccentrically positioned.

In the embodiments of the present invention as illustrated in the above drawings, the bag is sealed at not only the upper part but also the body of the bag. The present invention is by no means limited to this. For example, the gusseted bag 1A shown in FIGS. 1 and 2 may be modified into a gusseted bag 1H shown in FIG. 14 as a front view and in FIG. 15 as a schematic view, in which the sealed portions 4 are formed at the vertical edges of the upper part of the bag but no sealed portion 4 is formed at the vertical edges of the body of the bag. Also, the gusseted bag 1A shown in FIGS. 8A and 9 may be modified into a gusseted bag 1I shown in FIG. 16 as a front view and in FIG. 17 as a schematic view, in which the sealed portions 4 are formed at the vertical edges of the upper part of the bag and also the pour spout 2 is eccentrically positioned, but no sealed portion 4 is formed at the vertical edges of the body of the bag.

Figure 18A:
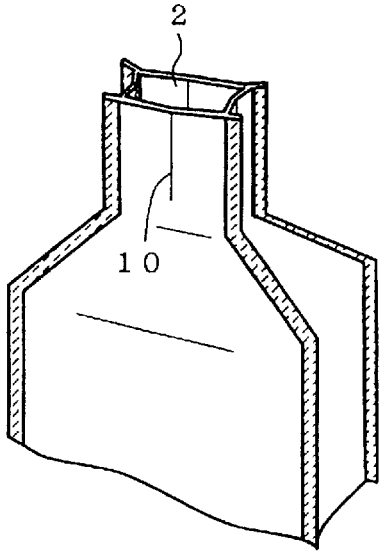
FIGS. 18A and 18B illustrate the gusseted bag of the present invention, having a ruled line at the pour spout.
Figure 18B:
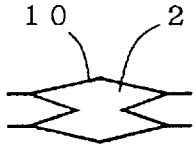

In the gusseted bag of the present invention, a ruled line 10 so formed that the wall surface portion is foldable outward may be provided at the bag wall surface portion forming the pour spout 2, as shown in FIG. 18A as a perspective view of the vicinity of the pour spout and in FIG. 18B as a top view of the pour spout. This also makes it easy to open the pour spout 2.

Figure 19:
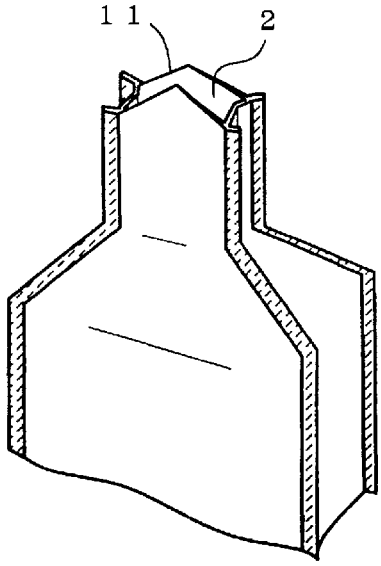
FIG. 19 is a perspective view of the gusseted bag of the present invention, having a pour spout whose top edges are cut in an inverted V.
Figure 20:
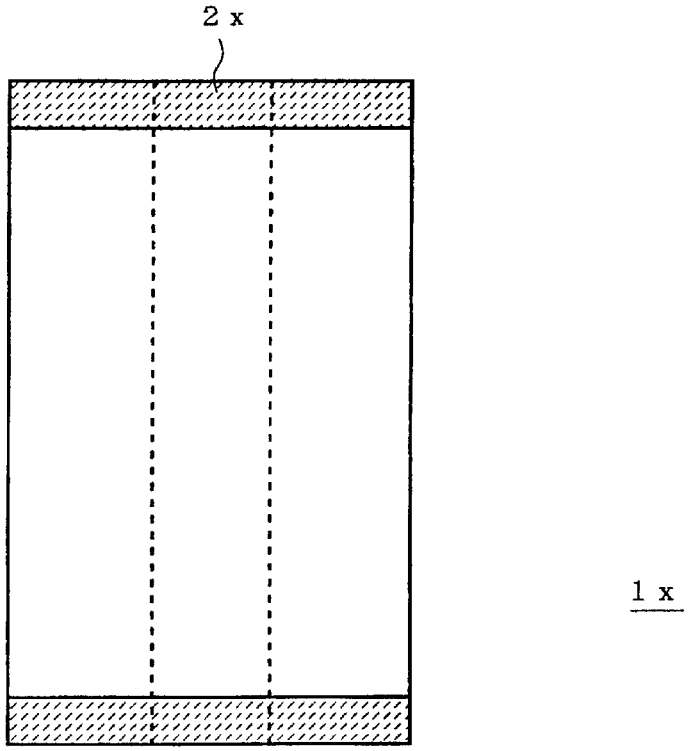
FIG. 20 is a front view of a conventional gusseted bag, which stands folded flat.
Figure 21:
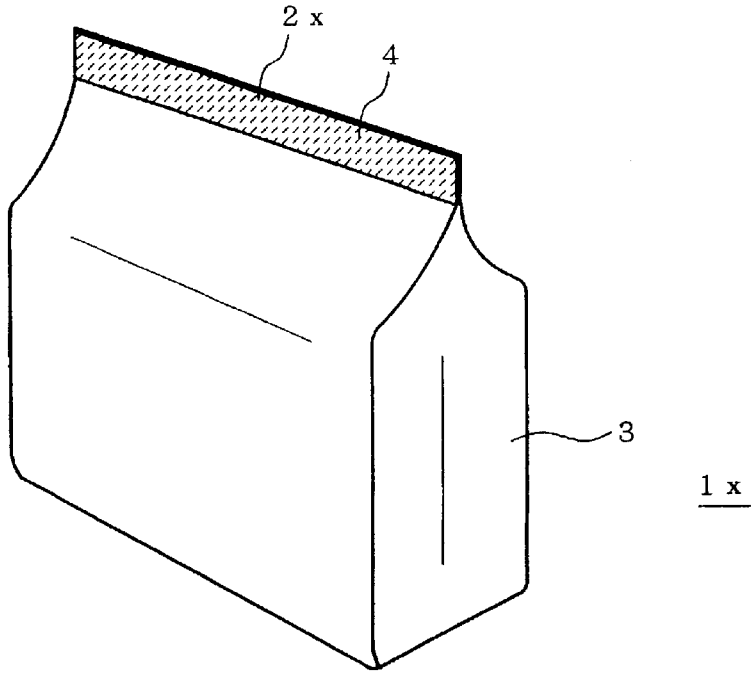
FIG. 21 is a perspective view of a conventional gusseted bag, which stands sealed after it has been filled with contents.

As shown in FIG. 19, in order to make it easy to open the pour spout 2, top edges 11 of the bag wall surface portion forming the pour spout 2 may be cut in an inverted V. For this purpose, a cut-off guide line or the like in the form of an inverted V may be, e.g., printed at the top edge of the pour spout 2 so that it can be readily cut off in an inverted V when the consumer opens the sealed pour spout 2.

There are no particular limitations on the contents with which the gusseted bag of the present invention is filled. They may include powdery or liquid materials such as detergents and bleachers.

INDUSTRIAL APPLICABILITY

According to the gusseted bag of the present invention, it becomes possible to rebottle the contents with ease and for sure even into narrow-necked bottle containers.

What is claimed is:

1. A gusseted bag comprising:

a bag having i) inwardly-folded V-shaped folds at opposing left and right sidewalls and ii) sealed portions at vertical edges of an upper part of said bag, wherein at said upper part of said bag, a distance between inside contours of said sealed portions set opposite one another in a horizontal direction is narrowed with respect to a body of said bag to form a non-sealed portion serving as a pour spout, outside contours of said sealed portions forming said pour spout form an outer shape narrowed with respect to said body of said bag, said pour spout being positioned eccentrically toward one side of said opposing left and right sidewalls, wherein a first inside contour of said inside contours on a first side of said sealed portions forming said pour spout is formed in agreement with one of said inside contours of said sealed portions of said vertical edges on said opposing left and right sidewalls at said body of said bag, and a second inside contour of said inside contours on a second side of said sealed portions forming said pour spout is formed in agreement with an innermost end of a V-shaped fold of said V-shaped folds in a sidewall of said opposing left and right sidewalls, said sidewall being located on said second side.

2. The gusseted bag according to claim 1, wherein said bag has, at a wall surface portion forming said pour spout, a ruled line so formed that said wall surface portion is foldable outwardly.

3. The gusseted bag according to claim 1, wherein a top edge of a bag wall surface portion forming said pour spout is cut in an inverted V.

4. The gusseted bag according to claim 1, wherein a first of said inside contours, on a first side of said sealed portions forming said pour spout, is formed between an innermost end of said inwardly-folded V-shaped folds at said opposing left and right sidewalls on said first side and said vertical edges on said opposing left and right sidewalls at said body of said bag, and a first of said inside contours, on a second side of said sealed portions forming said pour spout, is formed between innermost ends of said inwardly-folded V-shaped folds in both said opposing left and right sidewalls, and wherein said bag has, at a wall surface portion forming said pour spout, a ruled line so formed that said wall surface portion is foldable outwardly.

5. The gusseted bag according to claim 1, wherein a first of said inside contours, on a first side of said sealed portions forming said pour spout, is formed between an innermost end of said inwardly-folded V-shaped folds at said opposing left and right sidewalls on said first side and said vertical edges on said opposing left and right sidewalls at said body of said bag, and a first of said inside contours, on a second side of said sealed portions forming said pour spout, is formed between innermost ends of said inwardly-folded V-shaped folds in both said opposing left and right sidewalls, and wherein a top edge of a bag wall surface portion forming said pour spout is cut in an inverted V.

6. The gusseted bag according to claim 1, wherein a first of said inside contours, on a first side of said sealed portions forming said pour spout, is formed between an innermost end of a first of said inwardly-folded V-shaped folds on said first side and a first of said vertical edges on said opposing left and right sidewalls at said body of said bag, and a second of said inside contours, on a second side of said sealed portions forming said pour spout, is formed in agreement with one of said innermost ends of said first of said inwardly-folded V-shaped folds in both said opposing left and right sidewalls located on said second side, and wherein said bag has, at a wall surface portion forming said pour spout, a ruled line so formed that said wall surface portion is foldable outwardly.

7. The gusseted bag according to claim 1, wherein a first of said inside contours, on a first side of said sealed portions forming said pour spout, is formed between an innermost end of a first of said inwardly-folded V-shaped folds on said first side and a first of said vertical edges on said opposing left and right sidewalls at said body of said bag, and a second of said inside contours, on a second side of said sealed portions forming said pour spout, is formed in agreement with one of said innermost ends of said first of said inwardly-folded V-shaped folds in both said opposing left and right sidewalls located on said second side, and wherein a top edge of a bag wall surface portion forming said pour spout is cut in an inverted V.

8. The gusseted bag according to claim 1, wherein a first of said inside contours, on a first side of said sealed portions forming said pour spout, is formed in agreement with one of said inside contours of said sealed portions of a first of said vertical edges on said opposing left and right sidewalls at said body of said bag, and a second of said inside contours, on a second side of said sealed portions forming said pour spout, is formed between said innermost ends of said first of said inwardly-folded V-shaped folds in both said opposing left and right sidewalls, and wherein said bag has, at a wall surface portion forming said pour spout, a ruled line so formed that said wall surface portion is foldable outwardly.

9. The gusseted bag according to claim 1, wherein a first of said inside contours, on a first side of said sealed portions forming said pour spout, is formed in agreement with one of said inside contours of said sealed portions of a first of said vertical edges on said opposing left and right sidewalls at said body of said bag, and a second of said inside contours, on a second side of said sealed portions forming said pour spout, is formed between said innermost ends of said first of said inwardly-folded V-shaped folds in both said opposing left and right sidewalls, and wherein a top edge of a bag wall surface portion forming said pour spout is cut in an inverted V.

10. A gusseted bag comprising:

a bag having i) inwardly-folded V-shaped folds at opposing left and right sidewalls and ii) sealed portions at vertical edges of an upper part of said bag, wherein at said upper part of said bag, a distance between inside contours of said sealed portions set opposite one another in a horizontal direction is narrowed with respect to a body of said bag to form a non-sealed portion serving as a pour spout, outside contours of said sealed portions forming said pour spout form an outer shape narrowed with respect to said body of said bag, said pour spout being positioned eccentrically toward one side of said opposing left and right sidewalls, wherein a first inside contour of said inside contours on a first side of said sealed portions forming said pour spout is formed in agreement with one of said inside contours of said sealed portions of said vertical edges on a sidewall of said opposing left and right sidewalls at said body of said bag, and a second inside contour of said inside contours on a second side of said sealed portions forming said pour spout is formed between an innermost end of a V-shaped fold of said V-shaped folds in a sidewall of said opposing left and right sidewalls, said sidewall being located on said second side and said vertical edges on said sidewall of said opposing left and right sidewalls on said second side at said body of said bag.

11. The gusseted bag according to claim 10, further comprising a ruled line at a wall surface portion forming said pour spout, wherein said ruled line is formed so that said wall surface portion is foldable outwardly.

12. The gusseted bag according to claim 10, wherein a top edge of said wall surface portion forming said pour spout is cut in an inverted V.

13. The gusseted bag according to claim 10, wherein a first of said inside contours, on a first side of said sealed portions forming said pour spout, is formed between an innermost end of said inwardly-folded V-shaped folds at said opposing left and right sidewalls on said first side and said vertical edges on said opposing left and right sidewalls at said body of said bag, and a first of said inside contours, on a second side of said sealed portions forming said pour spout, is formed between innermost ends of said inwardly-folded V-shaped folds in both said opposing left and right sidewalls, and wherein said bag has, at a wall surface portion forming said pour spout, a ruled line so formed that said wall surface portion is foldable outwardly.

14. The gusseted bag according to claim 10, wherein a first of said inside contours, on a first side of said sealed portions forming said pour spout, is formed between an innermost end of said inwardly-folded V-shaped folds at said opposing left and right sidewalls on said first side and said vertical edges on said opposing left and right sidewalls at said body of said bag, and a first of said inside contours, on a second side of said sealed portions forming said pour spout, is formed between innermost ends of said inwardly-folded V-shaped folds in both said opposing left and right sidewalls, and wherein a top edge of a bag wall surface portion forming said pour spout is cut in an inverted V.

15. The gusseted bag according to claim 10, wherein a first of said inside contours, on a first side of said sealed portions forming said pour spout, is formed between an innermost end of a first of said inwardly-folded V-shaped folds on said first side and a first of said vertical edges on said opposing left and right sidewalls at said body of said bag, and a second of said inside contours, on a second side of said sealed portions forming said pour spout, is formed in agreement with one of said innermost ends of said first of said inwardly-folded V-shaped folds in both said opposing left and right sidewalls located on said second side, and wherein said bag has, at a wall surface portion forming said pour spout, a ruled line so formed that said wall surface portion is foldable outwardly.

16. The gusseted bag according to claim 10, wherein a first of said inside contours, on a first side of said sealed portions forming said pour spout, is formed between an innermost end of a first of said inwardly-folded V-shaped folds on said first side and a first of said vertical edges on said opposing left and right sidewalls at said body of said bag, and a second of said inside contours, on a second side of said sealed portions forming said pour spout, is formed in agreement with one of said innermost ends of said first of said inwardly-folded V-shaped folds in both said opposing left and right sidewalls located on said second side, and wherein a top edge of a bag wall surface portion forming said pour spout is cut in an inverted V.

17. The gusseted bag according to claim 10, wherein a first of said inside contours, on a first side of said sealed portions forming said pour spout, is formed in agreement with one of said inside contours of said sealed portions of a first of said vertical edges on said opposing left and right sidewalls at said body of said bag, and a second of said inside contours, on a second side of said sealed portions forming said pour spout, is formed between said innermost ends of said first of said inwardly-folded V-shaped folds in both said opposing left and right sidewalls, and wherein said bag has, at a wall surface portion forming said pour spout, a ruled line so formed that said wall surface portion is foldable outwardly.

18. The gusseted bag according to claim 10, wherein a first of said inside contours, on a first side of said sealed portions forming said pour spout, is formed in agreement with one of said inside contours of said sealed portions of a first of said vertical edges on said opposing left and right sidewalls at said body of said bag, and a second of said inside contours, on a second side of said sealed portions forming said pour spout, is formed between said innermost ends of said first of said inwardly-folded V-shaped folds in both said opposing left and right sidewalls, and wherein a top edge of a bag wall surface portion forming said pour spout is cut in an inverted V.

* * * * *